United States Patent [19]

Wood, Jr.

[11] 4,222,490

[45] Sep. 16, 1980

[54] APPARATUS FOR STORING SKIS

[76] Inventor: Theodore N. Wood, Jr., Pole 257, Harvey's Lake, Pa. 18618

[21] Appl. No.: 871,340

[22] Filed: Jan. 23, 1978

[51] Int. Cl.[2] ..... A47F 7/00; A63C 11/02

[52] U.S. Cl. ..... 211/60 SK; 269/230; 269/235; 269/321 W; 280/814

[58] Field of Search ..... 211/60, 37, 70, 64, 211/65, 66, 60 SK; 224/29 R, 42.03 R–42.1, 42.21, 42.25, 42.4, 45; 70/58; 280/11.37 A, 11.37 C, 11.37 K; 269/230, 235, 321 W

[56] References Cited

U.S. PATENT DOCUMENTS

| | | | |
|---|---|---|---|
| 602,177 | 4/1898 | Wiler | 211/64 |
| 2,133,883 | 10/1938 | Aubert | 211/60 SK |
| 2,956,812 | 10/1960 | Lundquist | 211/60 SK |
| 2,963,165 | 12/1960 | Steiner | 211/60 SK |
| 3,570,681 | 3/1971 | Kinshofer | 211/60 SK |
| 3,685,667 | 8/1972 | Bell | 211/60 SK |
| 3,826,378 | 7/1974 | Novak | 211/70 |
| 3,958,695 | 5/1976 | Allsop et al. | 211/37 |
| 4,078,708 | 3/1978 | Mayer | 211/60 SK |

FOREIGN PATENT DOCUMENTS

| | | | |
|---|---|---|---|
| 2143861 | 3/1972 | Fed. Rep. of Germany | 269/321 W |
| 285862 | 5/1931 | Italy | 211/60 T |

*Primary Examiner*—Thomas J. Holko

*Attorney, Agent, or Firm*—Burns, Doane, Swecker & Mathis

[57] ABSTRACT

An apparatus for storing multiple pairs of skis in bottom-to-bottom facing arrangement and in a generally upright orientation, with the skis contacting one another at forward and rearward contact zones, includes a generally upright support on which individually adjustable sets of upper and lower clamping assemblies are positioned. Both the upper clamping assembly and the lower clamping assembly of each set are operable to apply a releasable clamping force against the top surfaces of the associated pair of skis. At least one of the clamping assemblies is movable toward and away from the other one, whereby the clamping forces may be applied at spaced locations relative to the forward and rearward contact zones so as to restrain warping of the stored pair of skis. The support is rotatably mounted on a dish-like receptacle for melted snow. The clamping assemblies include cylindrical pressure members spaced to define a slot for receiving the skis along their edges, with the slot gap being adjustable through an eccentric mounting of the pressure members.

15 Claims, 10 Drawing Figures

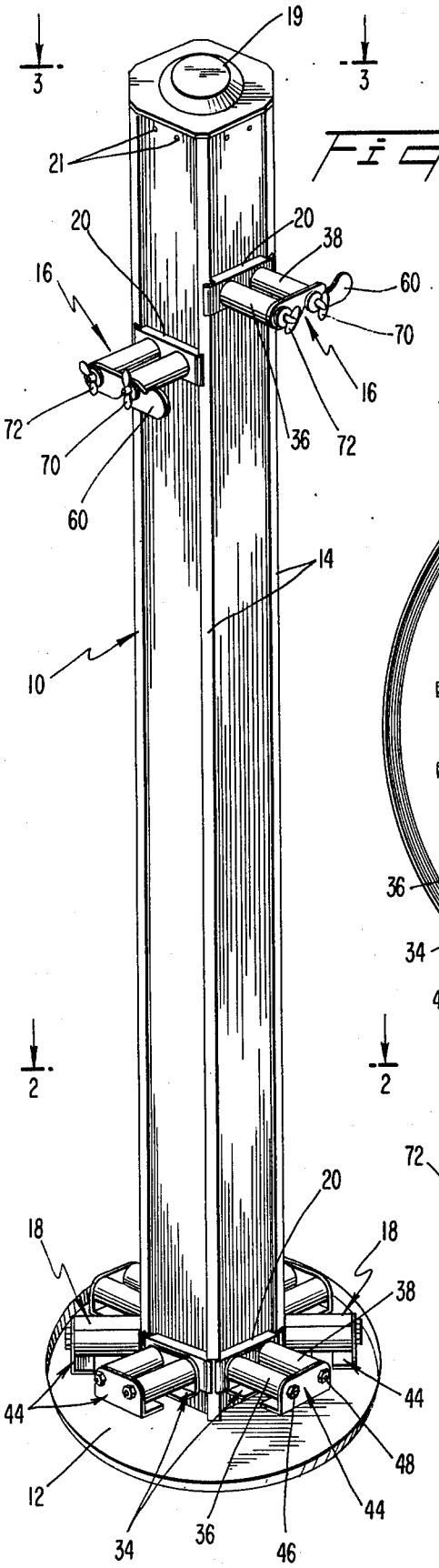
Fig. 1
Fig. 2
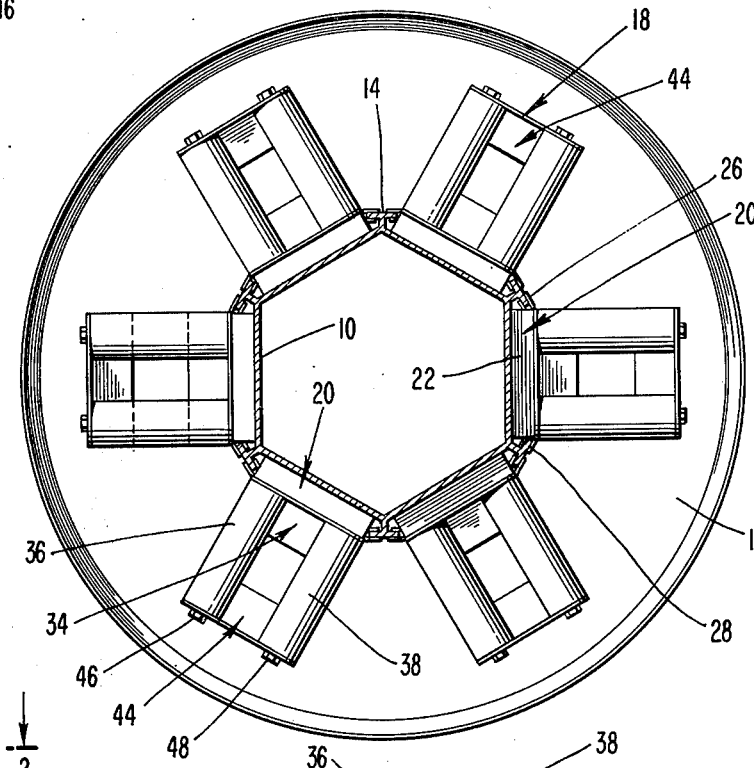
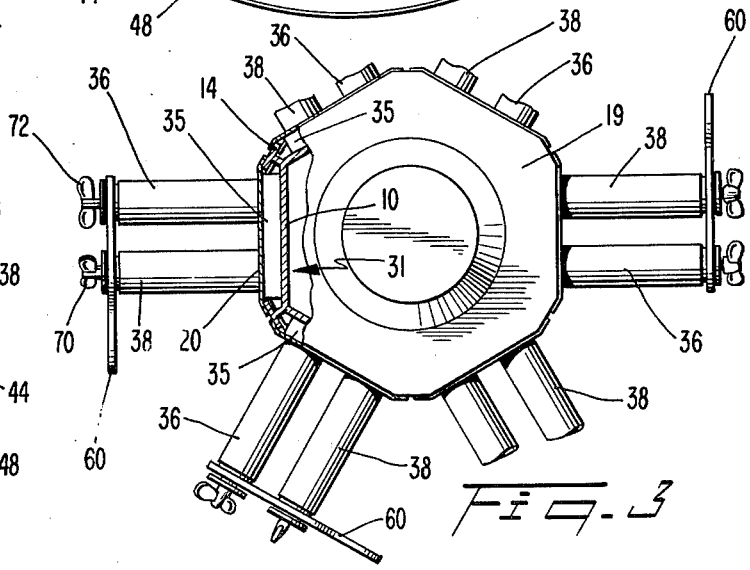
Fig. 3

Fig. 4
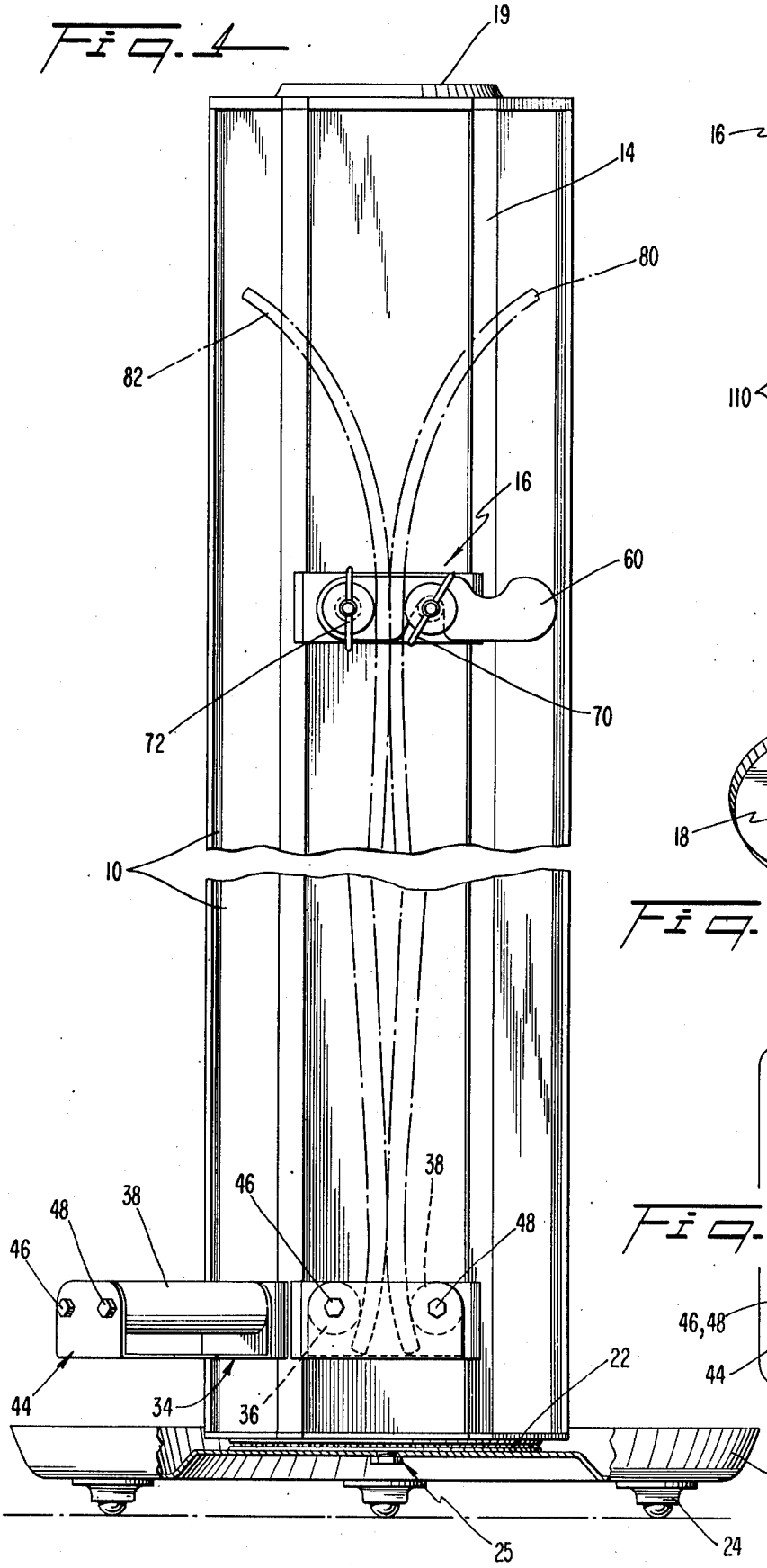
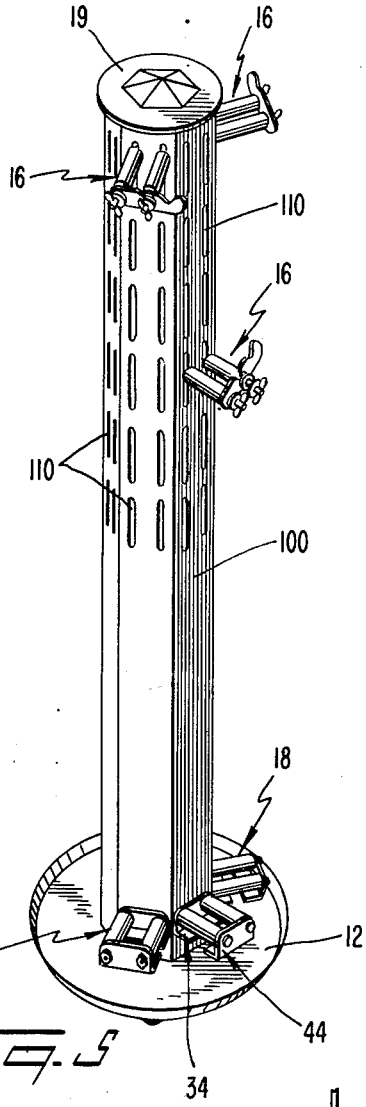
Fig. 5
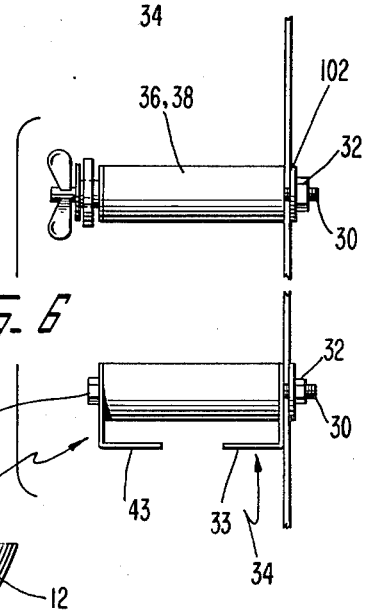
Fig. 6

Fig. 8
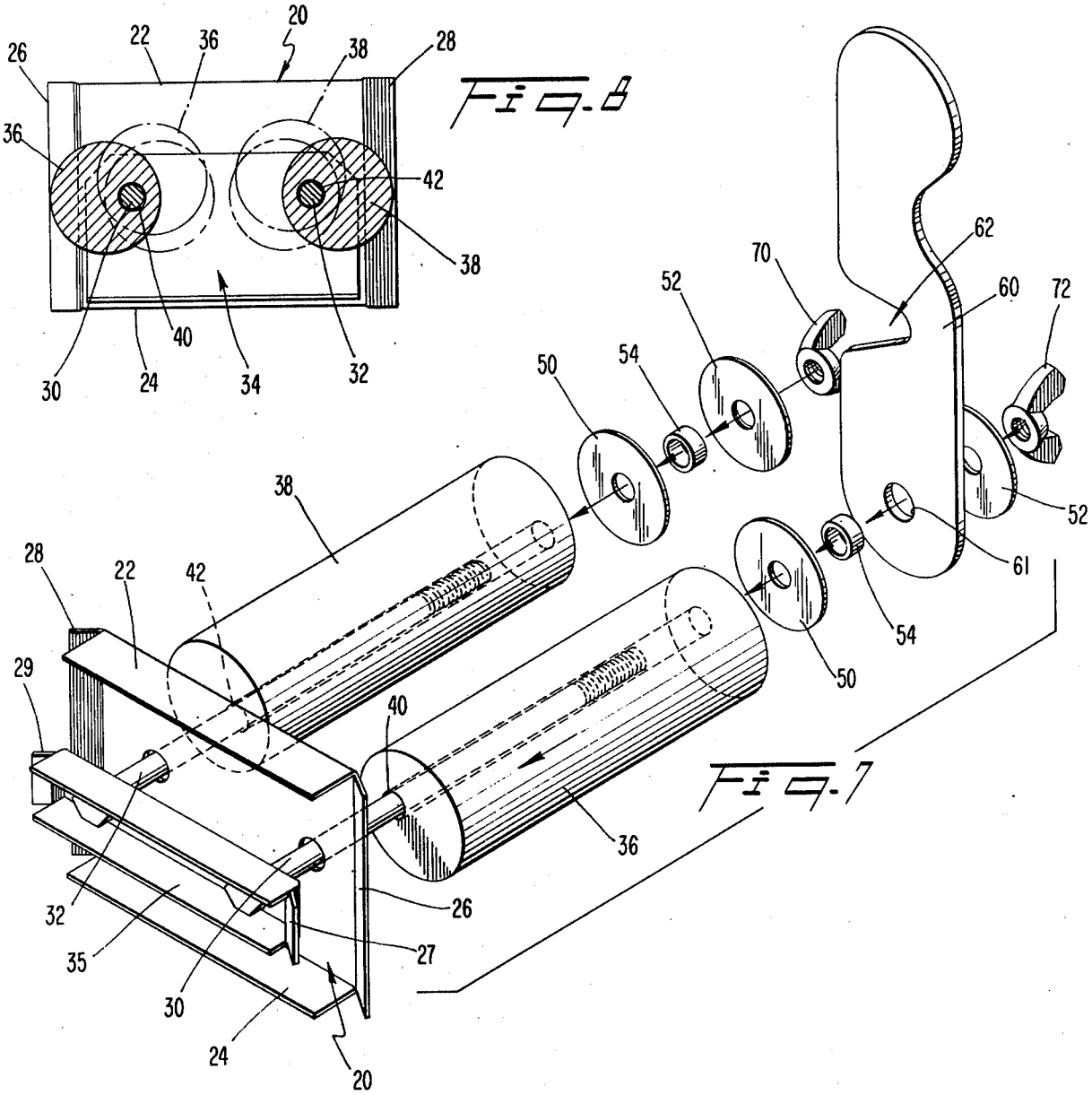
Fig. 7
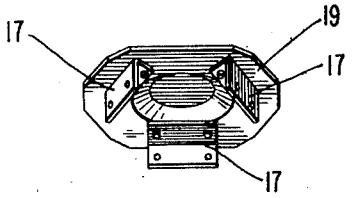
Fig. 9
Fig. 10
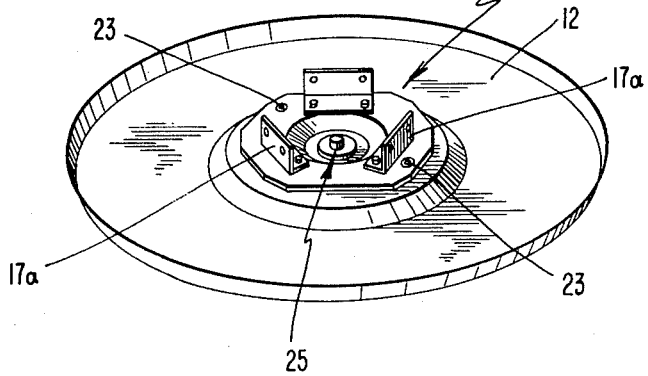

APPARATUS FOR STORING SKIS

BACKGROUND AND SUMMARY OF THE PRESENT INVENTION

This invention relates generally to a storage rack for skis. More particularly, this invention relates to a ski rack for storing skis of various lengths in a condition that militates against warpage.

Storage of skis either during relatively temporary periods of non-use, such as overnight during ski season, or during more extended periods, such as off-season, presents considerable problems for recreational skiers. For example, unless stored properly, the skis might experience warpage to varying degrees which could reduce the useful life of the skis, interfere with skiing performance or even lead to injury. In addition, unless stored on a rack of some sort, the skis are likely to present obstructions. Also, when skis are stored indoors during periods of frequency use, it is desirable that provisions be made for preventing melted ice and snow which sticks to the skis from wetting surrounding areas. Other problems such as those associated with storage convenience and accessibility to the stored skis can also be encountered. Where common storage of skis of different sizes is required, further storage difficulties might also be present.

Although there have been a variety of past proposals for ski storage that might alleviate some of the foregoing difficulties, room for improvement remains for a variety of reasons.

For example, one rotary ski rack suitable for use with multiple pairs of skis and ski poles is proposed in U.S. Pat. No. 3,826,378, issued July 30, 1974. The rack includes a disc which is provided with recesses and locking levers to retain skis and which is adjustable to a height representing the minimum length of all skis to be accommodated on the rack. However, there does not appear to be any particular provision in this proposal to combat warpage, and individualized adjustment for skis of different sizes is not contemplated.

In U.S. Pat. No. 2,963,165, issued Dec. 6, 1960 a coin operated ski checker is proposed. While in one disclosed embodiment a spring clip system may be employed to hold the forward portions of the stored pairs of skis, once again problems with warpage and accommodation for size variation could be encountered.

U.S. Pat. No. 3,330,573, issued July 11, 1967 proposes a ski wall rack for storing skis individually in a manner which prevents warpage of the skis. A camber block is positioned under a midsection of each ski, with forward and rearward ends of each ski being retained against a wall by clamps. However, limitations on storage location and difficulties associated with accommodating size variations are presented.

Other ski racks and clamps have been proposed in U.S. Pat. Nos. 3,874,512; 3,772,652; 2,133,883 and French Pat. No. 1,335,767 (1963). Some or all of the problems discussed above may be encountered with devices such as are disclosed therein.

It is an object of the present invention to provide a novel apparatus for storing skis that minimizes or obviates such problems.

It is a further object of the present invention to provide a novel apparatus for storing multiple pairs of skis in a space-efficient manner.

It is another object of the present invention to provide a novel apparatus for storing skis which is adapted to minimize warpage.

Another object of the present invention is to provide a novel apparatus for storing skis with individualized adjustment for size of the stored skis.

A further object of the present invention is to provide a novel ski storage apparatus including adjustable clamps.

Skis in common use for downhill skiing typically have a multicurved longitudinal profile. Centrally the skis are provided with a camber. The forward portion or tip of the ski is curved upwardly as is a lesser extent of the rear or tail of the ski. The present invention provides for storage of a pair of skis in bottom-to-bottom facing relationship with clamping of the skis adjacent both the forward and rear contact zones on opposite sides of the camber, the clamping location being adjustable dependent upon ski length to restrain warping.

Preferred embodiments of an apparatus according to the present invention include a generally upright support member rotatably mounted on a dish-like base about a vertical axis. The support presents a plurality of upright sides on each of which is positioned a set of upper and lower clamping assemblies.

The upper and lower clamping assemblies are vertically spaced from one another and each is operable to apply a releasable clamping force against the top surfaces of the bottom-to-bottom facing skis. At least one of the set of clamping assemblies is adjustably mounted for vertical movement toward and away from the other. In this fashion different lengths of skis to be stored can be individually accommodated, and preferably, the clamping forces are available to be applied at spaced locations so positioned relative to the forward and rear ski contact zones as to impose anti-warping stresses on the stored pairs of skis.

A positioning or locating member may be fixed to the lower clamping assemblies for engaging the rear ends of the stored pair of skis to locate the lower clamping assembly rearwardly of the normal rear contact zone of the skis, i.e. at the location of the curved tails.

The clamping assemblies preferably comprise first and second, generally cylindrical pressure members projecting outwardly from the upright support to define a slot for reception of the stored skis along their edges. At least one of the pressure members is eccentrically carried by a mounting pin so as to enable variations in width of the slot. A latch associated with one of the clamping assemblies, preferably the upper one, includes an arm pivotally mounted on the pin. The latch arm is operable both to close the slot between the pressure members and to hold them in clamping engagement with the skis received in the slot.

BRIEF DESCRIPTION OF THE DRAWINGS

Other objects and advantages of the present invention will become apparent from the subsequent detailed description of preferred embodiments thereof, with reference to the accompanying drawings in which like reference characters refer to like elements, and in which:

FIG. 1 is a pictorial view of one embodiment of a multi-sided ski rack according to the present invention;

FIG. 2 is a sectional view taken along line 2—2 of FIG. 1 and illustrating primarily the arrangement of the lower clamping assemblies;

FIG. 3 is a top view, partially broken away, taken along line 3—3 of FIG. 1 and illustrating primarily the upper clamping assemblies;

FIG. 4 is a side view of the ski rack of FIG. 1 showing the position of skis on the rack;

FIG. 5 is a pictorial view of another embodiment of a ski rack according to the present invention;

FIG. 6 is a side view depicting the upper and lower clamping assemblies of the present invention, used in the rack of FIG. 5;

FIG. 7 is an exploded pictorial view showing the upper clamping assemblies of the ski-rack of FIG. 1;

FIG. 8 is a front sectional view through the pressure members of the clamping assembly of FIG. 7;

FIG. 9 is a pictorial view of the cap for the ski rack of FIG. 1; and

FIG. 10 is a pictorial view of the base for the ski rack of FIG. 1.

DETAILED DESCRIPTION OF PREFERRED EMBODIMENTS

With reference to FIG. 1, one preferred embodiment of the present invention includes a vertically extending support member 10 which is rotatably attached to a base member 12. The vertical support member 10 may be a rigid metal member with a generally hexagonal cross section (see FIG. 2), and it has a length approximately equal to the length of fairly long adult skis. Typically the vertical support member extends approximately six to seven feet.

On each side of the support member 10, a single pair of skis may be mounted in bottom-to-bottom facing arrangement. As will be appreciated, the vertical support member may be provided with a greater or lesser number of sides, depending upon the number of pairs of skis desired to be stored.

With reference to FIG. 2, it will be seen that a T-shaped flange member 14 extends vertically along the entire length of each corner of the vertical support member 10. The T-shaped flanges 14 of adjacent corners of the vertical support member provide rails on which upper and lower clamping assemblies 16 and 18 may be secured in a manner more fully described below. The vertical support member 10 is preferably extruded as a single piece that may be fabricated, for example, from aluminum.

An end cap 19 (see FIG. 9) fits securely onto an upper end of the vertical support member 10 and may include a series of flanges 17 which extend into the hollow interior of the vertical support member to permit attachment of the end cap to the support member by screws 21 or the like. The vertical support member is rotatably attached to the base 12 by a ball thrust bearing 13 in any suitable manner, (see FIG. 4). The base 12 is a dish-like member having a diameter large enough so that that the outermost edge of the base member extends outwardly of the support 10 beyond the upper and lower clamping assemblies 16 and 18. As such, the base member is positioned to catch any water resulting from snow that melts from the skis stored on the ski rack. If desired, the base member 12 may be provided with casters 15 so that the ski rack may be easily moved about. One or more drain holes (not shown), with suitable plugs, may also be provided.

A bottom end cap **19*a*, similar to the top end cap 19, is attached to the top plate of the bearing 22 by rivets 23 or the like, so as to be rotatable therewith (see FIG. 10). The bottom end cap is provided with a series of flanges 17*a* which extend into the support member 10 and are attached thereto as described in connection with the top end cap 19. A bolt assembly 25 holds the bottom end cap 19*a*, the bearing 22 and the base 12 together as a unit, and permits rotation of the support member 10 relative to the base 12** about the central vertical axis of the support.

Each of the upper clamping assemblies 16 is carried by a mounting bracket 20 (see FIG. 7) with bent edges providing upper and lower flanges 22, 24 and side flanges 26, 28. The upper and lower flanges 22, 24 project inwardly toward the vertical support member 10 and have a length dimension about equal to the spacing between the T-shaped corners 14 of the support member 10. The side flanges 26 are disposed at an angle corresponding to the angle between the legs of the T-shaped corners and a vertical plane through the central axis of the support member. In this fashion the side flanges 28 overlap and embrace the outer surfaces of the T-rails 14, as indicated at 39 in FIG. 2.

A back-up plate 35 comprises U-shaped channel having flanges 27, 29 on either end. These flanges are angled in general conformity with the angle on the side flanges 26, 28 of the mounting bracket 20. These flanges 27, 29 of the back-up plate are thus oriented to embrace the inner surface of the T-rails, as indicated at 31 in FIG. 3.

The mounting bracket 20 and the back-up plate 35 are each provided with a pair of holes that are coaxially arranged. Suitable fasteners such as hexhead machine bolts 30, 32 extend outwardly from the back-up plate 35 through the bracket 20, with the head of the machine bolt fitting snugly within the channel of the back-up plate 35 so as to prevent rotation of the machine bolts.

At the time of assembly of the upper clamping assemblies 16 to the support member 10, the back-up plate 35 and the mounting bracket 20 are held together by the bolts 30, 32. This permits the side flanges 27, 29 and 26, 28 to be slid over the rails provided by the T-shaped edges 14 of the support 10. Subsequent tightening of the clamping assembly 16 fixes the clamping assembly rigidly in the desired vertical location along the rails 14, through tight gripping of the flanges on the rails. Adjustments in vertical position may be accomplished by loosening the clamping assembly and sliding the bracket 20 and its associated back-up plate 35 to a new location.

In this connection, with reference to FIG. 7, it will be appreciated that the bolts or pins 30, 32 extend through bores 40, 42 in a pair of pressure members 36, 38 in the form of wooden cylinders. At least one, and preferably both of the cylinders bores 40, 42 are eccentric with respect to the cylinder axes. The bore and bolt diameters are such as to provide a relatively snug fit while permitting rotation of the cylinders about the bolts.

The bolts 30, 32 are sufficiently long to project entirely through the pressure members so as to expose their threaded ends 53. Washers 50, 52 separated by bushings 54 are positioned on the bolts at the outer faces of the associated cylinder 36, 38. Tightening of the assembly is accomplished through wingnuts 70,72.

A latch member 60, having a thickness slightly less than the length of the bushings 54 is pivotally mounted on one of them by means of an aperture 61 that fits over the bushing. A slot 62 in the latch fits over the other bushing 54 when the latch arm 60 is swung to the position where it closes the slot defined between the cylindrical pressure members 36, 38. In this position, the latch arm 60 also securely latches the pressure members 36, 38 together. If desired, a suitable locking assembly could be associated with the latch arm to maintain it in the closed position and prevent unwanted removal of the stored skis from the rack.

The lower clamping assemblies 18 are essentially identical to the upper clamping assemblies 16 from the standpoint of the inclusion of the mounting bracket 20, back-up plate 35, pressure members 36, 38 and the associated bolts. However, no latch arm 60 with associated washers and bearings is included.

Instead, an apertured L-shaped flange 44 (see FIG. 1) is disposed over the end of the bolts. A similar, but oppositely oriented, flange 34 is positioned on the bolts between the cylindrical pressure members and the back-up plate 35. Ordinary hexhead nuts 46, 48, rather than wingnuts, may be employed to complete the assembly, particularly, if it is envisioned that the position of lower clamping assemblies will not be vertically-adjusted, although such adjustment may be accomplished if desired.

The horizontally extending flanges 33 and 43 of the flanged brackets 34 and 44 on the lower clamping assemblies 18 provide shelves on which the ends of the skis may be rested when storage is commenced. At the same time these flanges 33 and 43 provide a positioning member which limits the vertical location of the pressure members 36, 38 of the lower clamping assembly to a position close to the curved tails (see FIG. 4). This position is rearward of the rear contact zone of the back-to-back skis.

After the skis are so positioned, one or both of the eccentric pressure members of the lower clamping assemblies can be rotated to cause the pressure members to place a releasable clamping force on the top surface of the skis.

The upper clamping assembly 16 is raised to a desired vertical position, preferably at or slightly higher than the forward contact zone of the skis. One or both of the eccentric pressure members can be rotated to a position that provides the releasable clamping force when the latch arm 60 is closed to maintain that force.

Placement of the clamping forces slightly outside of the ski contact zones is particularly desired since any tendency toward warpage and loss of camber is resisted by stress induced in the skis that tends to increase the camber. This can be appreciated with reference to FIG. 4 where the curvature of the tails and tips of the skis has been exaggerated in the phantom illustration. Pressure on the skis at the curvature tends to move the ski contact zones outward and increase the camber, thus producing stresses that reduce warpage tendencies.

It will, however, be appreciated that even if the clamping forces are displaced from these desired locations, certain advantages of the present invention may be realized since the clamping at both ends of the skis, even if located at or inboard of the normal contact zones, will reduce the possibility of further loss of camber.

With reference now to FIG. 5, another embodiment of a ski rack according to the present invention will be appreciated. In this embodiment, the upper portion of each side of a vertical support member 100 is provided with a series of vertically spaced sets of elongated slots 110. The support member 100 may be attached to the dish-like base 12 in the manner described in connection with the embodiment of FIG. 1.

The upper clamping assemblies 16 carried by the support member 100 are also essentially identical to those described earlier, but they are differently mounted. In this connection, it will be apparent from FIG. 6 that in lieu of the mounting by means of a mounting bracket, etc., the machine bolts 30, 32 are projected directly through the slots 110 in the support member 100. The interior ends of these bolts may also be threaded, as illustrated, and a nut and washer assembly 102 may be employed to secure the respective pressure members in position at the desired vertical location in desired slot 110. For this purpose, access to the interior of the hollow support member 100 may be gained through removal of the end cap 19, which is not necessarily fastened to the support member 110 by screws or the like.

With the mounting of the upper clamping assemblies 16, some difference in vertical elevation between the pressure members 36 and 38 is possible, if desired.

The lower clamping assemblies 18 employed in the embodiment of FIG. 5 are also similar to those earlier described, but differently mounted. Here again, the mounting bracket, etc. are eliminated and the clamping assemblies 18 are secured to the support member 100 by the threaded interior end of the machine bolts 30, 32 and the nut and washer assembly 102. For this purpose holes are provided in the faces of the support. Preferably assembly of lower clamping assemblies 18 is accomplished prior to assembly of the base 12 with the support 100.

As in the case of the FIG. 1 embodiment, it is preferable that the clamping forces be located relative to the forward and rear ski contact zones so as to impose a stress on the skis which tends to flex them and increase the camber. This can be readily accomplished by locating the upper clamping assembly 16 at or slightly forward of the forward contact zone. The lower clamping assembly will ordinarily be positioned slightly rearward of the rear contact zone inasmuch as the ledges or shelves 33 and 43 of the brackets 34 and 44 associated therewith limit the distance by which the pressure application point can be located away from the ends of the ski tails. The force provided by the lower clamping assembly 18 thus exerts a torque in each of the skis which acts about the rear contact zone of the skis. This, combined with the resilient characteristics of the skis, causes the central portion of the skis to be urged outwardly so as to oppose warpage without the need for a wooden block or other spacer between the skis. Similar stresses can be induced by positioning the upper clamping assembly 16 slightly forward of the forward contact zone.

In one technique of storing a pair of skis on the illustrated ski racks of the present invention, the pair of skis are first arranged with the backs of each pair of skis directed towards one another. The rearwardmost portions of the skis are placed into contact with one another and the forwardmost portions of the skis are spaced apart from one another. The tail portions of the skis are next positioned in the lower clamping assemblies between the parallel wooden pressure cylinders, with the skis angled slightly away from the upright support. One or both of the pressure cylinders may be rotated so as to adjust the gap to provide the clamping force. The tips of the skis are now urged towards one another with the result that the lower clamping assembly exerts an increasingly greater stress on the skis. As the tips of the skis are urged together, the rearward point of contact tends to move forward by an extent determined by the curvature of the skis in longitudinal cross section. When the forward portions of the skis have been brought into contact with one another the pair of skis may be clamped between the wooden pressure cylinders of the upper clamping assembly. One or both of the pressure cylinders may be rotated so as to establish the clamping force. Preferably, the upper clamping assembly has been adjusted longitudinally on the vertical support member so that the upper clamping force is positioned approximately at the forward zone of contact of the pair of skis. The latch of the upper clamping assembly is finally pivoted into closed position.

Although the present invention has been described in connection with the preferred forms thereof, it will be appreciated by those skilled in the art that substitutions, additions, deletions and modifications may be made without departing from the spirit or scope of the present invention as defined in the appended claims.

What is claimed is:

1. An apparatus for storing at least one pair of skis in bottom-to-bottom facing arrangement and in a generally upright orientation, with the skis of each pair contacting one another at forward and rearward contact zones, the apparatus comprising:

a generally upright support;

upper and lower clamping means positioned on said support at locations vertically spaced from one another, and each operable to apply a releasable clamping force against the top surfaces of the bottom-to-bottom facing skis; and mounting means adjustably mounting at least one of said clamping means on said support for vertical movement toward and away from said other clamping means;

whereby said upper and lower clamping means are operable respectively to apply said clamping forces at spaced locations positioned relative to said forward and rearward contact zones so as to restrain the stored pair of skis against warping;

positioning means fixed to said lower clamping means and operable to engage the rear ends of the stored pair of skis to maintain said lower clamping means spaced rearwardly of the rearward contacting zone of the stored pair of skis;

said mounting means mounting said upper clamping means for movement toward and away from said lower clamping means;

said upper clamping means comprising:

first and second, generally cylindrical pressure members projecting outwardly from said support to define therebetween an outwardly open slot for reception of the stored skis along the edges;

a mounting pin eccentrically carrying one of said pressure members so as to enable variations in the width of said slot; and latch means including an arm pivotally mounted on said pin and operable both to close the outer end of said slot and to hold said pressure members in clamping engagement with the skis received in said slot; and said lower clamping means comprising:

first and second, generally cylindrical pressure members projecting outwardly from said support to define therebetween a slot for reception of the stored skis; and a mounting pin eccentrically carrying one of said pressure members so as to enable variations in the width of said slot; and wherein said slot is closed at its outer end by a bracket supporting said pressure members and presenting a ledge therebeneath which defines said positioning means.

2. The apparatus according to claim 1 wherein said support comprises:

a elongated stand; and a dish-like base supporting said stand.

3. The apparatus according to claim 5 wherein said stand is rotatably mounted on said base about a vertical axis.

4. The apparatus according to claim 3 wherein said stand comprises:

a plurality of upright sides on each of which is positioned a pair of said upper and lower clamping means.

5. The apparatus according to claim 4 wherein:

the stand is provided at the intersections of said upright sides with generally T-shaped rails; and said mounting means for each of said upper clamping means comprises a mounting plate and a back-up plate provided with flanges for riding on said rails.

6. Apparatus for storing multiple pairs of skis in bottom-to-bottom facing arrangement and a generally upright orientation, with the skis of each pair contacting one another at forward and rearward contact zones, the apparatus comprising:

a generally upright support presenting at least two ski support sides;

a set of upper and lower clamping means positioned on each of at least two of said sides of said support at locations vertically spaced from one another, with each of said clamping means being operable to apply a releasable clamping force to the top surfaces of a pair of skis positioned in bottom-to-bottom facing arrangement, each of said clamping means having an outwardly open slot for reception of the associated stored pair of skis;

mounting means adjustably mounting at least one of said clamping means of each of said sets for vertical movement toward and away from the other clamping means of that set;

the adjustable mounting of each set of clamping means being independent of the other set;

whereby the upper and lower clamping means of each of said sets are operable to apply clamping forces at spaced locations positioned relative to the forward and rearward contact zones of the associated stored pair of skis so as to restrain that stored pair of skis against warping;

at least one of said upper and lower clamping means of each of said sets including first and second, generally cylindrical pressure members projecting outwardly from said support to define therebetween the outwardly open slot of said at least one of said upper and lower clamping means for reception of the stored skis;

a mounting pin eccentrically carrying one of said pressure members so as to enable variations in the width of said slot; and positioning means fixed to each of said lower clamping means of each of said sets and operable both for engaging the rear ends of the associated stored pair of skis to maintain said lower clamping means spaced rearwardly of the rearward contacting zone of the stored pair of skis and for closing the outer end of the outwardly open slot in said lower clamping means of each of said sets.

7. The apparatus according to claim 6 wherein said support comprises:

an elongated stand rotatably mounted on a dish-like base.

8. The apparatus according to claim 6 wherein:

the stand is provided at the intersections of said upright sides with generally T-shaped rails; and said mounting means for each of said upper clamping means comprises a mounting plate and a back-up plate provided with flanges for riding on said rails.

9. The apparatus according to claim 6 wherein each of said lower clamping means comprises:

first and second pressure members projecting outwardly from said support to define therebetween a slot for reception of the stored skis; and mounting means for said pressure members to enable variations in the width of said slot; and wherein said slot is closed at its outer end by a bracket supporting said pressure members and presenting a ledge therebeneath which defines said positioning means.

10. Apparatus for storing multiple pairs of skis in bottom-to-bottom facing arrangement and a generally upright orientation, with the skis of each pair contacting one another at forward and rearward contact zones, the apparatus comprising:

a generally upright support presenting at least two ski support sides;

a set of upper and lower clamping means positioned on each of at least two of said sides of said support at locations vertically spaced from one another, with each of said clamping means being operable to apply a releasable clamping force to the top surfaces of a pair of skis positioned in bottom-to-bottom facing arrangements; and mounting means adjustably mounting at least one of said clamping means of each of said sets for vertical movement toward and away from the other clamping means of that set;

the adjustable mounting of each set of clamping means being independent of the other set;

whereby the upper and lower clamping means of each of said sets are operable to apply clamping forces at spaced locations positioned relative to the forward and rearward contact zones of the associated stored pair of skis so as to restrain that stored pair of skis against warping;

each of said upper clamping means comprising:

first and second, generally cylindrical pressure members projecting outwardly from said support to define therebetween an outwardly open slot for reception to the stored skis along the edges;

a mounting pin eccentrically carrying one of said pressure members so as to enable variations in the width of said slot; and latch means including an arm pivotally mounted on said pin and operable both to close the outer end of said slot and to hold said pressure members in clamping engagement with the skis received in said slot.

11. The apparatus according to claim 10 wherein each of said lower clamping means comprises:

first and second, generally cylindrical pressure members projecting outwardly from said support to define therebetween a slot for reception of the stored skis; and a mounting pin eccentrically carrying one of said pressure members so as to enable variations in the width of said slot; and wherein said slot is closed at its outer end by a bracket supporting said pressure members and presenting a ledge therebeneath which defines positioning means for engaging the rear ends of the stored pair of skis to maintain said lower clamping means spaced rearwardly of the rearward contacting zone of the stored pair of skis.

12. The apparatus according to claim 11 wherein said support comprises:

an elongated stand; and a dish-like base supporting said stand.

13. The apparatus according to claim 12 wherein said stand is rotatably mounted on said base about a vertical axis.

14. An apparatus for storing at least one pair of skis in bottom-to-bottom facing arrangment and in a generally upright orientation, with the skis of each pair contacting one another at forward and rearward contact zones, the apparatus comprising:

a generally upright support;

upper and lower clamping means positioned on said support at locations vertically spaced from one another, and each operable to apply a releasable clamping force against the top surfaces of the bottom-to-bottom facing skis; and mounting means adjustably mounting at least one of said clamping means on said support for vertical movement toward and away from said other clamping means;

whereby said upper and lower clamping means are operable respectively to apply said clamping forces at spaced locations positioned relative to said forward and rearward contact zones so as to retain the stored pair of skis against warping;

positioning means fixed to said lower clamping means and operable to engage the rear ends of the stored pair of skis to maintain said lower clamping means spaced rearwardly of the rearward contacting zone of the stored pair of skis;

said mounting means mounting said upper clamping means for movement toward and away from said lower clamping means;

said upper clamping means comprising:

first and second pressure members projecting outwardly from said support to define therebetween an outwardly open slot for reception to the stored skis along the edges;

mounting means for said pressure members to enable variations in the width of said slot; and latch means operable both to close the outer end of said slot and to hold said pressure members in clamping engagement with the skis received in said slot;

said lower clamping means comprising:

first and second pressure members projecting outwardly from said support to define therebetween a slot for reception of the stored skis; and mounting means for said pressure members to enable variations in the width of said slot; and wherein said slot is closed at its outer end by a bracket supporting said pressure members and presenting a ledge therebeneath which defines said positioning means.

15. Apparatus for storing multiple pairs of skis in bottom-to-bottom facing arrangement and a generally upright orientation, with the skis of each pair contacting one another at forward and rearward contact zones, the apparatus comprising:

a generally upright support presenting at least two ski support sides;

a set of upper and lower clamping means positioned on each of at least two of said sides of said support at locations vertically spaced from one another, with each of said clamping means being operable to apply a releasable clamping force to the top surfaces of a pair of skis positioned in bottom-to-bottom facing arrangements; and mounting means adjustably mounting at least one of said clamping means of each of said sets for vertical movement toward and away from the other clamping means of that set;

the adjustable mounting of said set of clamping means being independent of the other set;

whereby the upper and lower clamping means of each of said sets are operable to apply clamping forces at spaced locations positioned relative to the forward and rearward contact zones of the associated stored pair of skis so as to restrain that stored pair of skis against warping;

said lower clamping means comprising:

first and second pressure members projecting outwardly from said support to define therebetween a slot for reception of the stored skis; and mounting means for said pressure member to enable variations in the width of said slot;

said slot being closed at its outer end by a bracket supporting said presesure members and presenting a ledge therebeneath which defines positioning means for engaging the rear ends of the stored pair of skis to maintain said lower clamping means spaced rearwardly of the rearward contacting zone of the stored pair of skis.

* * * * *